US007461997B1

(12) United States Patent
Mack, II

(10) Patent No.: US 7,461,997 B1
(45) Date of Patent: Dec. 9, 2008

(54) SIDEWALK AND SLAB LIFTING SYSTEM

(76) Inventor: Thomas M. Mack, II, 5508 Winding Brook La., Valrico, FL (US) 44594

( * ) Notice: Subject to any disclaimer, the term of this patent is extended or adjusted under 35 U.S.C. 154(b) by 52 days.

(21) Appl. No.: 11/644,918

(22) Filed: Dec. 22, 2006

(51) Int. Cl.
*E01C 23/10* (2006.01)

(52) U.S. Cl. ..... 404/78; 404/75; 404/101

(58) Field of Classification Search ..... 404/78, 404/75, 101
See application file for complete search history.

(56) References Cited

U.S. PATENT DOCUMENTS

| | | | | | |
|---|---|---|---|---|---|
| 1,920,443 | A * | 8/1933 | Milburn | 417/118 |
| 1,976,857 | A * | 10/1934 | Poulter | 404/78 |
| 2,041,266 | A * | 5/1936 | Poulter | 404/78 |
| 2,074,756 | A * | 3/1937 | Poulter | 404/108 |
| 2,286,761 | A * | 6/1942 | Poulter | 404/108 |
| 2,378,995 | A * | 6/1945 | Freeman | 405/230 |
| 3,097,763 | A * | 7/1963 | Aluotto | 222/43 |
| 3,814,180 | A * | 6/1974 | Oliver | 166/99 |
| 4,092,832 | A | 6/1978 | Mattson | |
| 4,470,719 | A | 9/1984 | Dziark et al. | |
| 4,567,708 | A * | 2/1986 | Haekkinen | 52/742.13 |
| 4,711,603 | A | 12/1987 | Rippe, Jr. et al. | |
| 5,188,024 | A * | 2/1993 | Li | 100/274 |
| 5,433,848 | A * | 7/1995 | Platter et al. | 210/238 |
| 5,527,108 | A * | 6/1996 | Miller | 366/157.3 |
| 5,810,050 | A * | 9/1998 | Pickerrell et al. | 137/625.41 |
| 5,979,879 | A * | 11/1999 | Asplin | 254/133 R |
| 6,419,127 | B1 * | 7/2002 | Fershtut | 222/334 |
| 6,976,804 | B1 * | 12/2005 | Asplin | 404/78 |
| 2003/0035741 | A1 * | 2/2003 | Tseng | 417/374 |
| 2005/0133636 | A1 * | 6/2005 | Steingass et al. | 239/539 |
| 2005/0252563 | A1 * | 11/2005 | Ledo et al. | 137/884 |
| 2006/0032869 | A1 * | 2/2006 | Younkle | 222/399 |
| 2007/0092336 | A1 * | 4/2007 | Hall et al. | 404/101 |

* cited by examiner

*Primary Examiner*—Thomas B Will
*Assistant Examiner*—Alina Schiller
(74) *Attorney, Agent, or Firm*—Edward P Dutkiewicz

(57) ABSTRACT

A tube body having open upper and lower ends and a cylindrical bore there between has an opening along the length thereof. A driver is secured to the tube body adjacent to the upper end. A push rod has a free end. The free end is adapted to move downwardly to an advanced orientation adjacent to the lower end and upwardly to a retracted orientation above the opening. A control component with an operator controlled handle is adapted to move the ram. A funnel is secured to the tube body. The funnel is adapted to feed particulate material into the bore when in the retracted orientation and from the bore when in the advanced orientation.

1 Claim, 4 Drawing Sheets

FIG 1
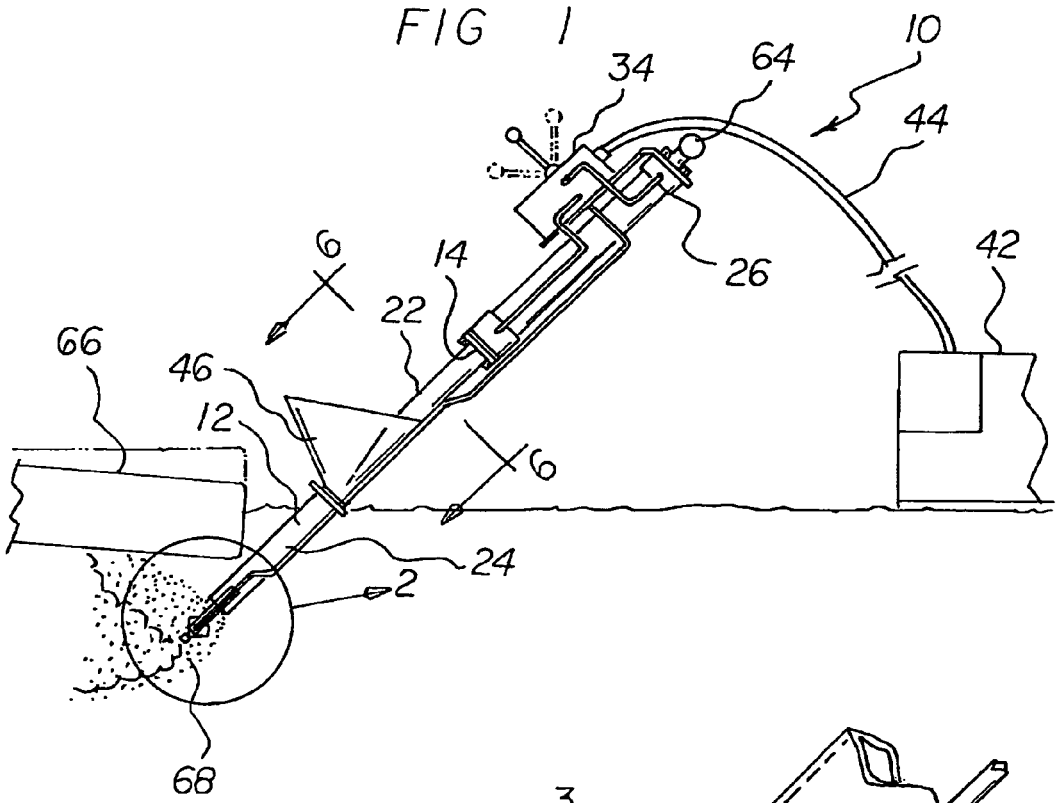
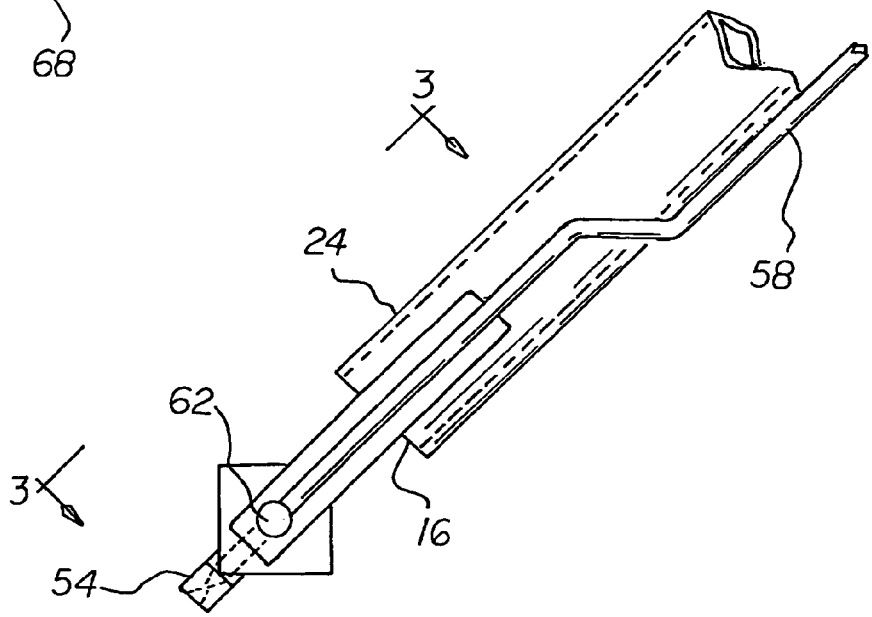
FIG 2

FIG 3
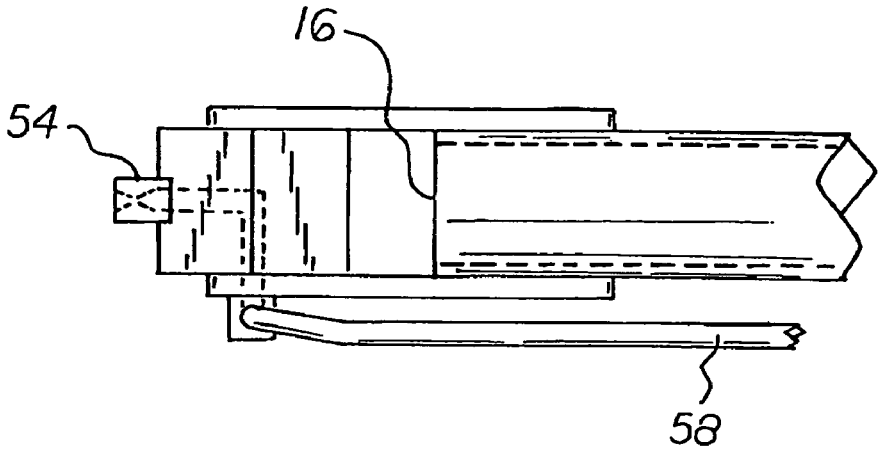
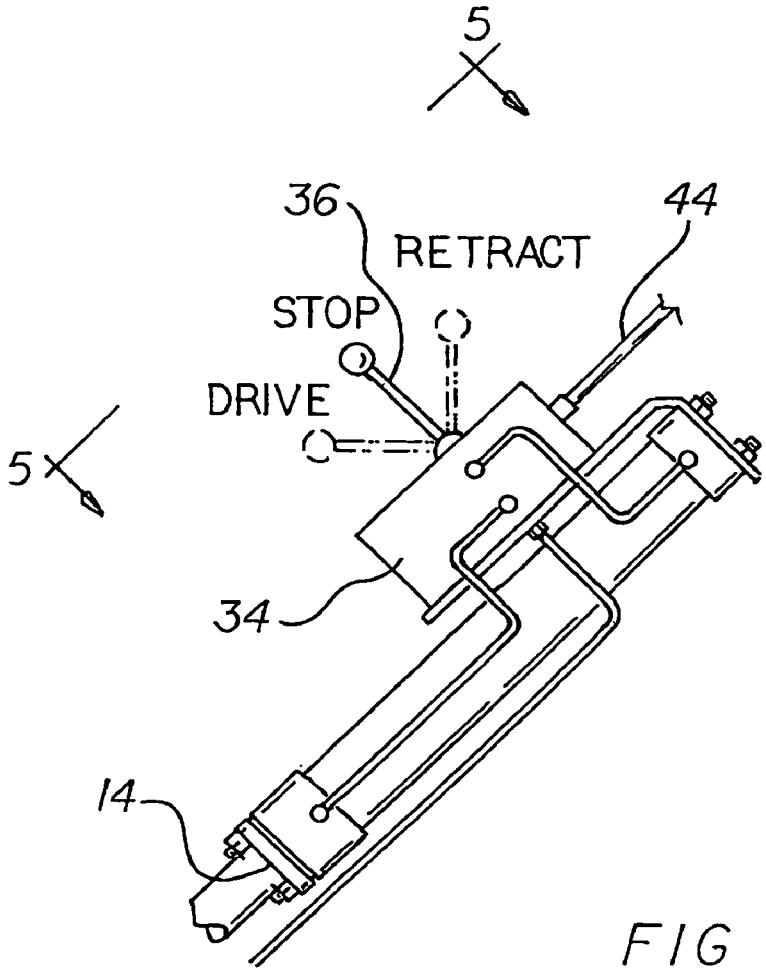
FIG 4

FIG 5
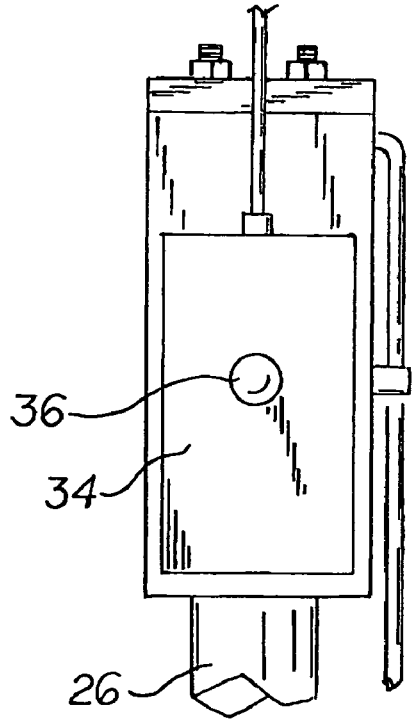
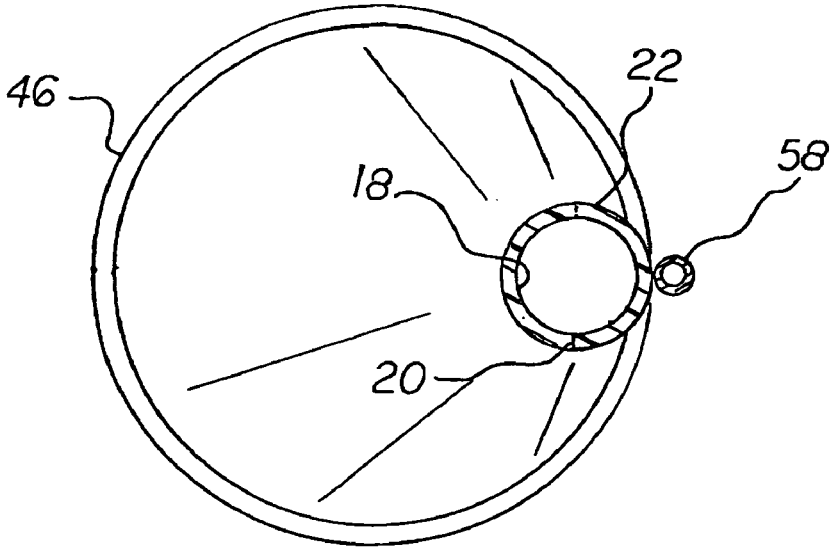
FIG 6

SIDEWALK AND SLAB LIFTING SYSTEM

BACKGROUND OF THE INVENTION

1. Field of the Invention

The present invention relates to a sidewalk and slab lifting system and more particularly pertains to introducing particular material beneath a sunken component to raise it to a desired level in a safe and reliable manner.

2. Description of the Prior Art

The use of lifting systems of known designs and configurations is known in the prior art. More specifically, lifting systems of known designs and configurations previously devised and utilized for the purpose of lifting particulate matter through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 7,000,606 issued Feb. 21, 2006 to Gardner relates to a Method and Apparatus for Removing Trip Hazards in Concrete Sidewalks. U.S. Pat. No. 6,976,804 issued Dec. 20, 2005 to Asplin relates to a Method of Repairing Damaged Concrete Slabs. U.S. Pat. No. 6,558,071 issued May 6, 2003 to Sproules relates to a Pavement System. U.S. Pat. No. 6,521,673 issued Feb. 18, 2003 to Brown relates to a Composition and Method for Preparing Polyurethanes and Polyurethane Foams. U.S. Pat. No. 6,419,127 issued Jul. 16, 2002 to Fershtut relates to an Apparatus for Raising Concrete Members. U.S. Pat. No. 6,092,517 issued Jul. 25, 2000 to Schanel relates to a Concrete Surface Trimming Apparatus. U.S. Pat. No. 6,068,425 issued May 30, 2000 to Fershtut relates to a Method and Apparatus for Raising Concrete Members. U.S. Pat. No. 5,979,879 issued Nov. 9, 1999 to Asplin relates to a Sidewalk Leveling Device. U.S. Pat. No. 4,711,603 issued Dec. 8, 1987 to Rippe relates to a Slab Jacking Process and Apparatus. U.S. Pat. No. 4,470,719 issued Sep. 11, 1984 to Dziark relates to a Method for Repairing or Preventing Faulting on Concrete Highways. U.S. Pat. No. 4,567,708 issued Feb. 4, 1986 to Haekkinen relates to a Method for Leveling Sunken or Broken Portions of Earth-Supported Floors and Slabs. Lastly, U.S. Pat. No. 4,092,832 issued Jun. 6, 1978 to Mattison relates to a Method of Correcting the Height Level of a Foundation.

While these devices fulfill their respective, particular objectives and requirements, the aforementioned patents do not describe a sidewalk and slab lifting system that allows introducing particular material beneath a sunken component to raise it to a desired level in a safe and reliable manner.

In this respect, the sidewalk and slab lifting system according to the present invention substantially departs from the conventional concepts and designs of the prior art, and in doing so provides an apparatus primarily developed for the purpose of introducing particular material beneath a sunken component to raise it to a desired level in a safe and reliable manner.

Therefore, it can be appreciated that there exists a continuing need for a new and improved sidewalk and slab lifting system which can be used for introducing particular material beneath a sunken component to raise it to a desired level in a safe and reliable manner. In this regard, the present invention substantially fulfills this need.

SUMMARY OF THE INVENTION

In view of the foregoing disadvantages inherent in the known types of lifting systems of known designs and configurations now present in the prior art, the present invention provides an improved sidewalk and slab lifting system. As such, the general purpose of the present invention, which will be described subsequently in greater detail, is to provide a new and improved sidewalk and slab lifting system and method which has all the advantages of the prior art and none of the disadvantages.

To attain this, the present invention essentially comprises a sidewalk and slab lifting system. First provided is a tube body. The tube body is fabricated of steel. The tube body is in a generally cylindrical configuration. The tube body has an open upper end. The tube body has an open lower end. The tube body has a cylindrical bore provided between the upper and lower ends. The tube body has an opening. The opening is provided along the length of the tube body closer to the lower end than to the upper end. In this manner a longer upper portion of the tube body and a shorter lower portion of the tube body are defined.

A hydraulic cylinder is provided. The hydraulic cylinder is secured to the tube body adjacent to the upper end. The hydraulic cylinder has a ram. The ram is located within the bore. In this manner movement is reciprocated within the ram. The ram has a cylindrical push rod. The cylindrical push rod is coupled to the ram. The cylindrical push rod has a free end. The free end is adapted to move downwardly to an advanced orientation adjacent to the lower end. The free end is further adapted to move upwardly to a retracted orientation above the opening.

Provided next is a control valve. The control valve has an operator controlled handle. The operator controlled handle is movable between a central position and a first and second. Hydraulic lines couple the control valve and the ram. The ram and push rod are stationary and a forward position. The ram and push rod are moved forward through the first hydraulic line and a rearward position. The ram and push rod are moved rearward through the second hydraulic line. The control valve also includes a fluid supply and a feed line. The feed line couples the fluid supply and the control valve.

Further provided is a funnel. The funnel is fabricated of reinforced rubber. The funnel has a narrow output end. The narrow output end is secured to the tube body immediately beneath the opening. The funnel has a wide input end. The wide input end is adapted to feed particulate material into the bore when in the retracted orientation. In this manner particulate material in the bore will be fed to beneath the lower end of the tube body when in the advanced orientation. Further in this manner a sunken component is lifted. The sunken component includes a sidewalk and a slab. The sidewalk and the slab are located above the lower end of the tube body and particulate material.

Provided last is a water pressure assembly. The water pressure assembly includes a nozzle. The nozzle has a bracket. The bracket is adapted to secure the nozzle axially spaced beyond the lower end of the tube body at a distance to allow the flow of particulate material from the tube body. The water pressure assembly includes tubing. The tubing has an input end. The input end is operatively coupled to the control valve. The output end is operatively coupled to the nozzle. The water pressure assembly is operatively coupled to the operator controlled handle. In this manner when the operator controlled handle is in the central position and rearward position the flow of water is terminated and when the operator controlled handle is in forward position the flow of water is initiated to facilitate movement of the lower end of the tube body into the proper orientation for feeding particulate material.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sidewalk and slab lifting system which has all of the advantages of the prior art lifting systems of known designs and configurations and none of the disadvantages.

It is another object of the present invention to provide a new and improved sidewalk and slab lifting system which may be easily and efficiently manufactured and marketed.

It is further object of the present invention to provide a new and improved sidewalk and slab lifting system which is of durable and reliable constructions.

An even further object of the present invention is to provide a new and improved sidewalk and slab lifting system which is susceptible of a low cost of manufacture with regard to both materials and labor, and which accordingly is then susceptible of low prices of sale to the consuming public, thereby making such sidewalk and slab lifting system economically available to the buying public.

Even still another object of the present invention is to provide a sidewalk and slab lifting system for introducing particular material beneath a sunken component to raise it to a desired level in a safe and reliable manner.

Lastly, it is an object of the present invention to provide a new and improved sidewalk and slab lifting system. A tube body having open upper and lower ends and a cylindrical bore there between has an opening along the length thereof. A driver is secured to the tube body adjacent to the upper end. A push rod has a free end. The free end is adapted to move downwardly to an advanced orientation adjacent to the lower end and upwardly to a retracted orientation above the opening. A control component with an operator controlled handle is adapted to move the ram. A funnel is secured to the tube body. The funnel is adapted to feed particulate material into the bore when in the retracted orientation and to feed particulate material from the bore when in the advanced orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the primary and preferred embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a sidewalk and slab lifting system constructed in accordance with the principles of the present invention.

FIG. 2 is an enlarged side elevational view of a lower portion of the system taken at circle 2 of FIG. 1.

FIG. 3 is a plan view of a lower portion of the system taken along line 3-3 of FIG. 2.

FIG. 4 is an enlarged side elevational view of an upper portion of the system.

FIG. 5 is a plan view of a portion of the system taken along line 5-5 of FIG. 4.

FIG. 6 is a cross sectional view taken along line 6-6 of FIG. 1.

The same reference numerals refer to the same parts throughout the various Figures.

DESCRIPTION OF THE PREFERRED EMBODIMENT

Figure 7:
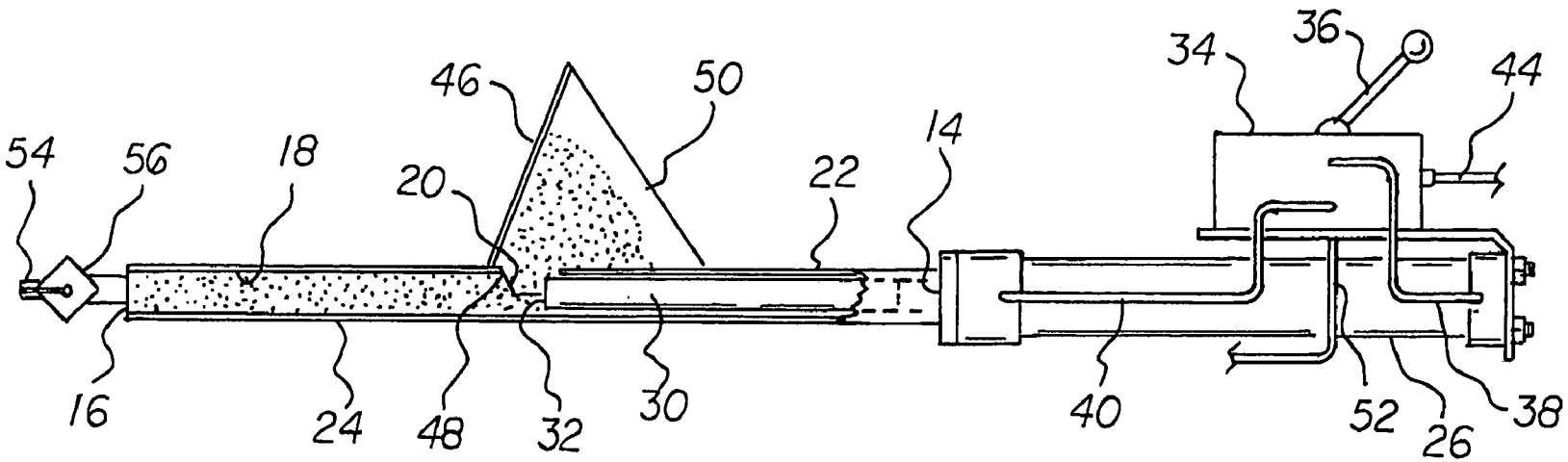
FIG. 7 is a side elevational view, partly in cross section, illustrating the push rod in a retracted orientation.

With reference now to the drawings, and in particular to FIG. 1 thereof, the preferred embodiment of the new and improved sidewalk and slab lifting system embodying the principles and concepts of the present invention and generally designated by the reference numeral 10 will be described.

The present invention, the sidewalk and slab lifting system 10 is comprised of a plurality of components. Such components in their broadest context include a tube body, a driver, a control valve and a funnel. Such components are individually configured and correlated with respect to each other so as to attain the desired objective.

First provided is a tube body 12. The tube body is fabricated of steel. The tube body is in a generally cylindrical configuration. The tube body has an open upper end 14. The tube body has an open lower end 16. The tube body has a cylindrical bore 18 provided between the upper and lower ends. The tube body has an opening 20. The opening is provided along the length of the tube body closer to the lower end than to the upper end. In this manner a longer upper portion 22 of the tube body and a shorter lower portion 24 of the tube body are defined.

Figure 8:
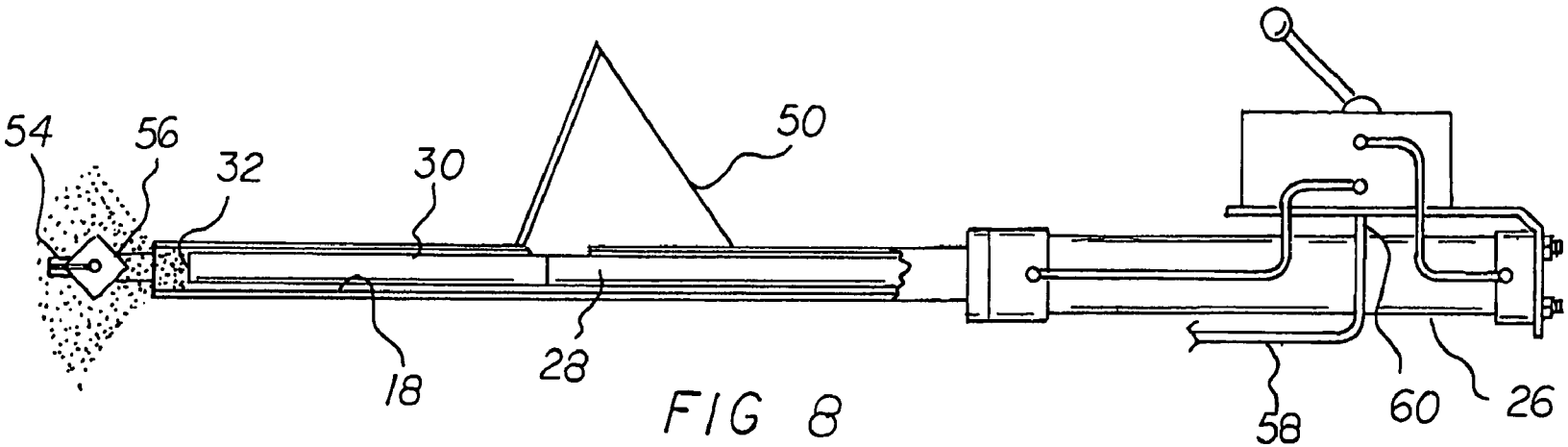
FIG. 8 is a side elevational view, partly in cross section, illustrating the push rod in an advanced orientation.

A driver, preferably a hydraulic cylinder 26, is provided. The hydraulic cylinder is secured to the tube body adjacent to the upper end. The hydraulic cylinder has a ram 28. The ram is located within the bore. In this manner movement is reciprocated within the ram. The ram has a cylindrical push rod 30. The cylindrical push rod is coupled to the ram. The cylindrical push rod has a free end 32. The free end is adapted to move downwardly to an advanced orientation adjacent to the lower end. Note FIG. 7. The free end is further adapted to move upwardly to a retracted orientation above the opening. Note FIG. 8.

Provided next is a control valve 34. The control valve has an operator controlled handle 36. The operator controlled handle is movable between a central position and first and second positions. Note in FIGS. 1 and 4 the solid line showings for the central or STOP position and the broken line showings for the first or DRIVE position and the second or RETRACT position. Hydraulic lines 38, 40 couple the control valve and the ram. The ram and push rod are stationary and a forward position. Note FIG. 8. The ram and push rod are moved forward through the first hydraulic line and a rearward position. Note FIG. 7. The ram and push rod are moved rearward through the second hydraulic line. The control valve also includes a fluid supply 42 and a feed line 44. The feed line couples the fluid supply and the control valve.

Further provided is a funnel 46. The funnel is fabricated of reinforced rubber. The funnel has a narrow output end 48. The narrow output end is secured to the tube body immediately beneath the opening. The funnel has a wide input end 50 The wide input end is adapted to feed particulate material into the bore when the push rod is in the retracted orientation. In this manner particulate material in the bore will be fed to beneath the lower end of the tube body when the push rod is moved to the advanced orientation. Further in this manner a sunken component is lifted. The sunken component includes a sidewalk and a slab. The sidewalk and the slab are located above the lower end of the tube body and particulate material.

Provided last is a water pressure assembly 52. The water pressure assembly includes a nozzle 54. The nozzle has a bracket 56. The bracket is adapted to secure the nozzle axially spaced beyond the lower end of the tube body at a distance to allow the flow of particulate material from the tube body. The water pressure assembly includes tubing 58. The tubing has an input end 60. The input end is operatively coupled to the control valve. The tubing also has a output end 62 which is operatively coupled to the nozzle. The water pressure assembly is operatively coupled to the operator controlled handle. In this manner when the operator controlled handle is in the central position and rearward position the flow of water is terminated and when the operator controlled handle is in forward position the flow of water is initiated to facilitate movement of the lower end of the tube body into the proper orientation for feeding particulate material.

Handling the system is enhanced by handle bars 64 at the upper end of the hydraulic cylinder. This allows the user to properly position the lower end of the tube body beneath a slab or sidewalk 66 to be leveled by the driving of particulate material 68 such as dry sand or pea gravel to an intended location beneath the sunken slab or sidewalk.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sidewalk and slab lifting system for introducing particulate material beneath a sunken component to raise it to a desired level in a safe and reliable manner comprising, in combination:

a tube body fabricated of steel in a generally cylindrical configuration having an open upper end and an open lower end with a cylindrical bore there between, the tube body having an opening along the length thereof closer to the lower end than to the upper end to define a longer upper portion of the tube body and a shorter lower portion of the tube body;

a hydraulic cylinder secured to the tube body adjacent to the upper end with a ram located within the bore for reciprocating movement there within, the ram having a cylindrical push rod coupled to the ram with a free end adapted to move downwardly to an advanced orientation adjacent to the lower end and upwardly to a retracted orientation above the opening;

a control valve with an operator controlled handle movable between a central position and first and second hydraulic lines coupling the control valve and the ram wherein the ram and push rod are stationary and a forward position wherein the ram and push rod are moved forwardly through the first hydraulic line and a rearward position wherein the ram and push rod are moved rearwardly through the second hydraulic line, the control valve also including a fluid supply and a feed line coupling the fluid supply and the control valve;

a funnel fabricated of reinforced rubber and having a narrow output end secured to the tube body immediately beneath the opening and a wide input end there above adapted to feed particulate material into the bore when the push rod is in the retracted orientation whereby particulate material in the bore will be fed to beneath the lower end of the tube body when the push rod is in the advanced orientation to thereby lift a sunken component including a sidewalk and a slab located above the lower end of the tube body and particulate material; and a water pressure assembly including a nozzle with a bracket adapted to secure the nozzle axially spaced beyond the lower end of the tube body at a distance to allow the flow of particulate material from the tube body, the water pressure assembly including tubing with an input end operatively coupled to the control valve and an output end operatively coupled to the nozzle, the water pressure assembly being operatively coupled to the operator controlled handle whereby when the operator controlled handle is in the central position and rearward position the flow of water is terminated and when the operator controlled handle is in forward position the flow of water is initiated to facilitate movement of the lower end of the tube body into the proper orientation for feeding particulate material.

* * * * *